US011572997B2

(12) United States Patent
Berger et al.

(10) Patent No.: US 11,572,997 B2
(45) Date of Patent: Feb. 7, 2023

(54) HEADLIGHT FOR VEHICLES

(71) Applicant: HELLA GmbH & Co. KGaA, Lippstadt (DE)

(72) Inventors: Gerhard Berger, Riedlingsdorf (AT); Raimund Kerschbaummayr, Golling (AT); Daniel Hochwarter, Tulbing (AT)

(73) Assignee: HELLA GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 17/287,688

(22) PCT Filed: Oct. 15, 2020

(86) PCT No.: PCT/EP2020/078990
§ 371 (c)(1),
(2) Date: Apr. 22, 2021

(87) PCT Pub. No.: WO2021/083672
PCT Pub. Date: May 6, 2021

(65) Prior Publication Data

US 2022/0268414 A1 Aug. 25, 2022

(30) Foreign Application Priority Data

Oct. 29, 2019 (DE) ..... 10 2019 129 100.3

(51) Int. Cl.
*F21S 41/141* (2018.01)
*F21S 41/32* (2018.01)
(Continued)

(52) U.S. Cl.
CPC ..... *F21S 41/321* (2018.01); *F21S 41/143* (2018.01); *F21S 41/334* (2018.01); *F21S 41/36* (2018.01); *F21Y 2115/10* (2016.08)

(58) Field of Classification Search
CPC ..... F21S 41/334; F21S 41/36; F21S 41/321; F21S 41/143; F21S 41/33; F21S 41/336;
(Continued)

(56) References Cited

U.S. PATENT DOCUMENTS 10,323,816 B2 6/2019 Huber et al.
10,451,237 B1 10/2019 Zorn
(Continued)

FOREIGN PATENT DOCUMENTS

DE 102010033707 A1 2/2012
DE 102018201980 A1 8/2019
(Continued)

OTHER PUBLICATIONS

Notification of Transmittal of Translation of the International Preliminary Report on Patentability with English Translation of Written Opinion dated May 12, 2022, in International Application No. PCT/EP2020/078990.
(Continued)

*Primary Examiner* — Omar Rojas Cadima
(74) *Attorney, Agent, or Firm* — Patent Central LLC; Stephan A. Pendorf

(57) ABSTRACT

A headlight for vehicles, with a light source, a reflector arrangement containing at least one reflector module, a first reflector, which has a reflector surface having a first focal point and a second focal point, the light source being arranged at the first focal point, and a second reflector, which has a reflector surface having a focal point that coincides with the second focal point of the first reflector. The first reflector is arranged in front of the light source in the main radiation direction, the reflector surface of the first reflector being curved, with a first opening portion arranged counter to the main radiation direction and with a second opening portion arranged in a manner offset by 90° in relation to the
(Continued)

Figure 1:
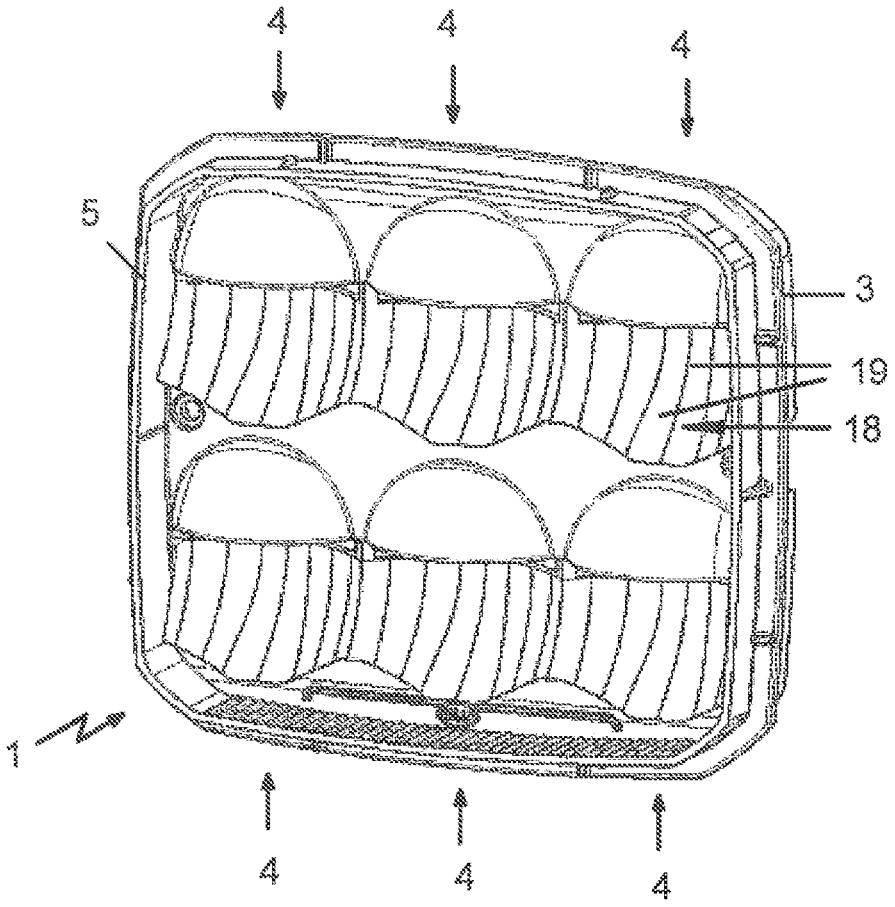

first opening portion and facing towards the second reflector. The reflector surface of the second reflector has free-form parts such that light striking the reflector surface of the second reflector is reflected in such a way that a light distribution having a predetermined light/dark boundary is produced.

15 Claims, 2 Drawing Sheets

(51) Int. Cl.

| | |
|---|---|
| ***F21S 41/36*** | (2018.01) |
| ***F21S 41/143*** | (2018.01) |
| ***F21S 41/33*** | (2018.01) |
| *F21Y 115/10* | (2016.01) |

(58) Field of Classification Search
CPC ..... F21S 41/365; F21S 41/60; B60Q 1/04; B60Q 1/28; B60Q 2400/30
See application file for complete search history.

(56) References Cited

U.S. PATENT DOCUMENTS

| | | | | |
|---|---|---|---|---|
| 2019/0234575 | A1* | 8/2019 | Laminette ..... | F21S 41/147 |
| 2021/0033254 | A1 | 2/2021 | Erdl et al. | |

FOREIGN PATENT DOCUMENTS

| | | | | |
|---|---|---|---|---|
| EP | 3351849 | A1 | | 7/2018 |
| JP | 2003229006 | A | | 8/2003 |
| JP | 2020098724 | A | * | 6/2020 |
| JP | 2020177864 | A | * | 10/2020 |
| WO | 2018094431 | A1 | | 5/2018 |
| WO | 2019073105 | A1 | | 4/2019 |

OTHER PUBLICATIONS

English translation of Written Opinion and International Search Report dated Jan. 11, 2021, in International Application No. PCT/EP2020/078990.

* cited by examiner

HEADLIGHT FOR VEHICLES

The invention relates to a headlight for vehicles, comprising a light source, comprising a reflector arrangement containing at least one reflector module, comprising a first reflector, which has a reflector surface having a first focal point and a second focal point, the light source being arranged at the first focal point, and comprising a second reflector, which has a reflector surface having a focal point that coincides with the second focal point of the first reflector.

DE 10 2010 033 707 A1 discloses a headlight for vehicles which has a light source and a reflector arrangement. The reflector arrangement has a first reflector with an ellipsoidal surface. The first reflector is directly associated with the light source. The reflector arrangement further has a second reflector with a paraboloidal surface and is arranged in front of the first reflector in the light radiation direction. The light source is arranged in a first focal point of the first reflector. A second focal point of the first reflector coincides with a focal point of the second reflector. In order to produce a light/dark boundary of the light distribution provided by the headlight, the light source is rotated and translated relative to the first focal point of the first reflector. The light reflected by the first reflector exits the reflector from an edge plane facing the light source. The drawback to the known headlight is that it is necessary for the light source to be precisely adjusted. Moreover, the light source is visible at an acute viewing angle, meaning that a bright point is noticeable on a lens covering a housing of the headlight. Disadvantageously, the headlight requires a relatively large installation depth.

The object of the present invention is to further develop a headlight for vehicles having only one reflector arrangement for deflecting the light, in such a way that a predetermined light distribution having a light/dark boundary is produced in space-saving manner, wherein the light source is not visible from the outside.

In order to achieve this object, the invention is, in conjunction with the preamble of claim 1, characterized in that the first reflector is arranged in front of the light source in the main radiation direction, the reflector surface of the first reflector being curved, with a first opening portion arranged counter to the main radiation direction and with a second opening portion arranged in a manner offset by 90° in relation to the first opening portion and facing towards the second reflector, and wherein the reflector surface of the second reflector has free-form parts such that light striking the reflector surface of the second reflector is reflected in such a way that a light distribution having a predetermined light/dark boundary is produced.

The particular advantage of the headlight according to the invention is that is it possible to produce a predetermined light distribution having a light/dark boundary in a space-saving manner, a light source being completely shielded from the view of an observer from the outside by a first reflector of the reflector arrangement. Undesired glare is thus reduced. The light/dark boundary is produced by the second reflector alone. For this purpose, said second reflector has a reflector surface having free-form parts, by means of which the desired light distribution can be produced.

According to a further development of the invention, the free-form parts are formed by faceting, wherein preferably a plurality of facet elements in the millimeter range are distributed over the paraboloidal surface of the second reflector. The light emitted by the light source is thus scattered by the second reflector, while said light is focused by the first reflector.

According to a further development of the invention, a main axis of the light source extends in the main radiation direction of the headlight. By means of the first reflector, a 90° deflection of the light emitted by the light source occurs. A further 90° deflection occurs by means of the second reflector.

According to a further development of the invention, the first and second focal points of the first reflector extend on a straight line that is inclined in relation to a vertical. The headlight has a small installation depth.

According to a further development of the invention, a rear edge of the first reflector and/or a rear edge of the second reflections is arranged in front of the first focal point of the first reflector in the main radiation direction such that there is sufficient space between the light source and the reflectors. This allows for an improvement in thermal convection.

According to a further development of the invention, a front edge of the second reflector is arranged to the rear of a front edge of the first reflector, and preferably a rear edge of the second reflector is arranged in front of the rear edge of the first reflector in the main radiation direction. Advantageously, this allows a more compact reflector arrangement having a small installation depth.

According to a further development of the invention, the first and second reflectors form a reflector module. The headlight has a number of reflector modules that are arranged in pairs one above the other and each have the same design. Advantageously, this allows the luminosity to be increased in conjunction with a small installation depth.

According to a further development of the invention, a plurality of reflector modules arranged in pairs is provided so as to be able to further increase the luminosity.

According to a further development of the invention, the reflector modules are integrally interconnected, said reflector modules preferably forming a single metal-coated injection-molded part. This allows the manufacturing costs to be reduced.

According to a further development of the invention, the first reflector is curved in the main radiation direction, and the second reflector is curved counter to the main radiation direction. Advantageously, this leads to improved ventilation and increased thermal convection around the light source. The temperatures can be kept low since no lenses are arranged close to the light source. Advantageously, the light source can be operated at a higher power.

Further advantages of the invention can be found in the other dependent claims.

One exemplary embodiment of the invention is described below in more detail with reference to the drawings.

Figure 2:
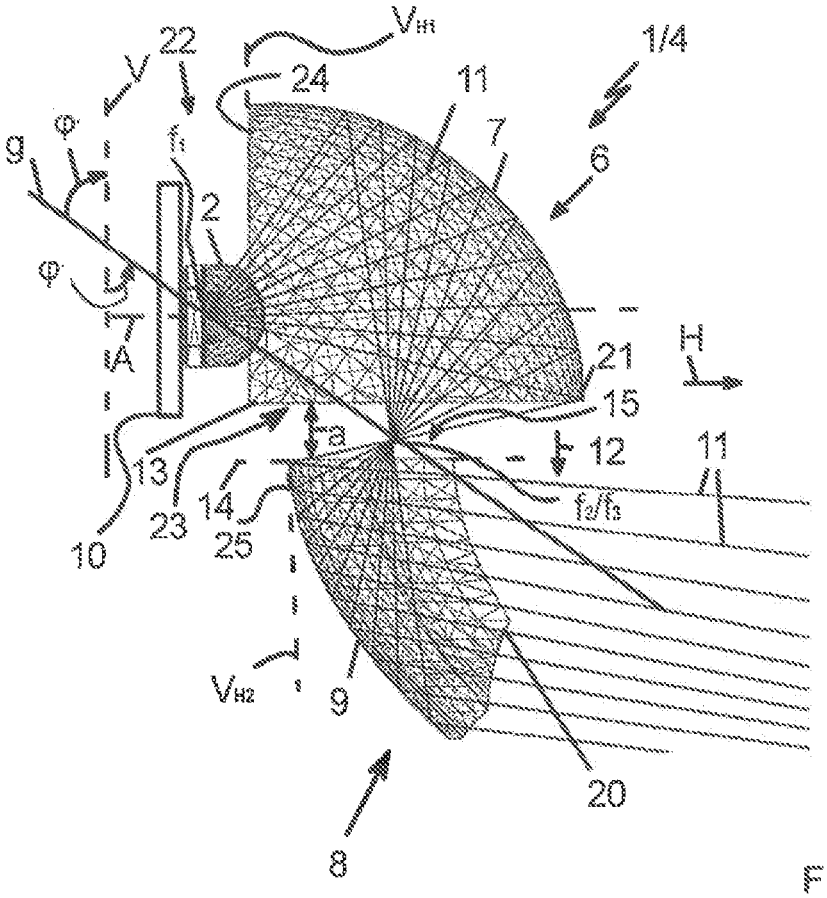
Figure 3:
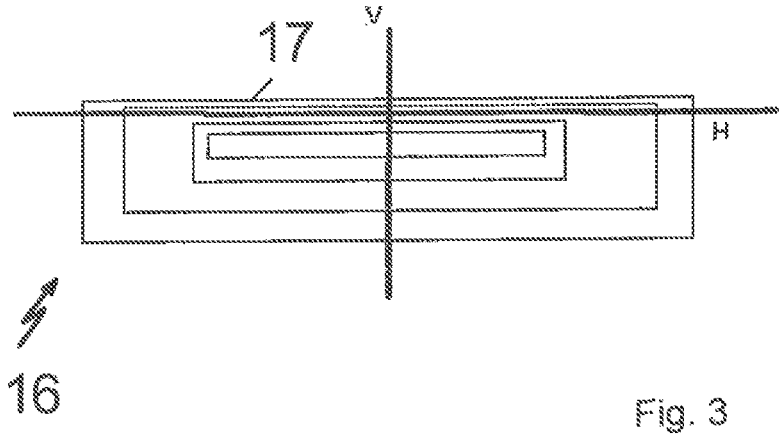

In the drawings:

FIG. 1 is a front view of a headlight according to the invention having a reflector arrangement containing six reflector modules, FIG. 2 is a side view of a reflector module in which light beams have been marked, and FIG. 3 shows a light distribution having a light/dark boundary.

A headlight according to the invention is preferably used as a working headlight that is used, for example, for agricultural and construction machinery, snowmobiles, ships and boats. The working headlight described below is suitable for reducing glare since a reflector arrangement 1 that completely shields a light source 2 of the working headlight is provided.

The headlight has a housing 3 in which reflector modules 4 arranged in pairs one above the other are arranged. In the present working headlight, three pairs of reflector modules 4 are arranged horizontally one next to the other.

The reflector modules 4 are integrally interconnected. The reflector modules 4 are formed by a single metal-coated injection-molded part. The reflector arrangement 1 thus has a peripheral edge that surrounds the six reflector modules 4. The reflector modules 4 are each connected to the frame and/or adjacent reflector modules on an upper side, on a lower side and on vertical edges sides.

The housing 3 has a front edge 5 that forms an opening that is closed by a transparent cover lens which is not shown. Cooling ribs, which are not shown, adjoin the rear side of the edge 4 of the housing 3.

The reflector arrangement 1 has a total of six reflector modules 4, the reflector modules 4 being arranged in pairs in the vertical direction. The reflector modules 4 each have a first reflector 6 containing an ellipsoidal reflector surface 7 and a second reflector 8 having a paraboloidal reflector surface 9.

The first reflector 6 is arranged in front of the light source 2 in the main radiation direction H of the headlight. The light source 2 can be designed as an LED light source that is mounted on a supporting element 10. The supporting element 10 is preferably designed as a printed circuit board. The light source 2 is preferably designed as a top LED light source that radiates light 11 normal to the printed circuit board 10. A main axis A of the light source 2 thus extends in the main radiation direction H.

The second reflector 8 is arranged in the front of the first reflector 6 in the light radiation direction 12 thereof, preferably at a distance a from the first reflector 6. A lateral edge plane 13 of the first reflector 6, from which the light 11 radiates from the first reflector 6, is arranged at a distance a from the entry plane 14 of the second reflector 8. A gap 15 is thus formed between the first reflector 6 and the second reflector 8. Since the light source 2 is shielded by the first reflector 6, the light source 2 does not directly radiate light towards the cover lens.

The light source 2 is arranged at a first focal point $f_1$ of the ellipsoidal reflector surface 7 of the first reflector 6. A second focal point $f_2$ of the ellipsoidal surface 7 of the first reflector 6 coincides with the focal point $f_3$ of the reflector surface 9 of the second reflector 8. The first reflector 6 is used substantially to focus the light 11 and to shield the light source 2, while the second reflector 8 is used to scatter the light 11 according to a predetermined light distribution 16 having a light/dark boundary 17.

The reflector surface 9 of the second reflector 8 has free-form parts such that the predetermined light distribution 16 having the light/dark boundary 17 is produced. The free-form parts are formed by faceting 18. To produce the light distribution 16 having the light/dark boundary 17, the second reflector 8 has faceting 18 having a plurality of facet elements 19 that are distributed over the surface of the paraboloidal main surface 9 of the second reflector 8. Said facet elements 19 have a dimension in the millimeter range and shape the light to produce the predetermined light distribution 16.

As can be seen from FIG. 2 in particular, the curved first reflector 6 has a first opening portion 22 arranged counter to the main radiation direction H of the headlight and an opening portion 23 arranged in a manner offset by 90° in relation to the first opening portion 22 and facing towards the second reflector 8. The second reflector 8 has a curvature such that an opening thereof points in the main radiation direction H of the headlight.

The first reflector 6 has a rear edge 24, and the second reflector 8 has a rear edge 25, said edges extending in vertical planes $V_{H1}$ and $V_{H2}$, respectively, which are either the same or, as shown in FIG. 2, not the same, the vertical planes $V_{H1}$ and $V_{H2}$ being arranged in front of the first focal point $f_1$ of the first reflector 6 in the main radiation direction H. In the present exemplary embodiment, the rear edge 25 of the second reflector 8 is arranged in front of the rear edge 24 of the first reflector 6 in the main radiation direction H. Both the first reflector 6 and the second reflector 8 are therefore arranged at a distance from the light source 2 in the main radiation direction H. In this way, it is possible to better ventilate the area around the light source 2 and thus to improve thermal convection.

It is clear that the first focal point $f_1$ and the second focal point $f_2$ of the first reflector 6 are arranged on a straight line g that is inclined in relation to a vertical plane V. The vertical V and the straight line g form an acute angle φ, which can be in the range of 30° to 70°. In the present exemplary embodiment, the angle φ=55°. The straight line g is thus rearwardly inclined from the vertical plane V by the acute angle φ.

As can be seen from FIG. 2, a front edge 20 of the second reflector is arranged to the rear of a front edge 21 of the first reflector 6 in the main radiation direction H such that the installation depth is determined by the first reflector 6.

As can be seen from FIG. 3, the light/dark boundary 17 is symmetrically arranged in relation to a vertical V.

According to an alternative embodiment which is not shown, the number of reflector modules 4 may vary. If the light source has a high luminosity, the headlight may also have just a single pair of reflector modules 4 or a single reflector module 4.

The invention claimed is:

1. A headlight for vehicles, comprising:

a light source (2), and a reflector arrangement (1) containing at least one reflector module (4):

the at least one reflector module (4) comprising:

a first reflector (6), which has a reflector surface (7) having a first focal point ($f_1$) and a second focal point ($f_2$), the light source (2) being arranged at the first focal point ($f_1$), and a second reflector (8), which has a reflector surface (9) having a focal point ($f_3$) that coincides with the second focal point ($f_2$) of the first reflector (6);

wherein the first reflector (6) is arranged in front of the light source (2) in the main radiation direction (H), the reflector surface (7) of the first reflector (6) being curved, with a first opening portion (22) arranged counter to the main radiation direction (H) and with a second opening portion (23) arranged in a manner offset by 90° in relation to the first opening portion (22) and facing towards the second reflector (8), wherein the reflector surface (9) of the second reflector (8) has free-form parts (18) such that light (11) striking the reflector surface (9) of the second reflector (8) is reflected in such a way that a light distribution (16) having a predetermined light/dark boundary (17) is produced, wherein the first focal point and the second focal point of the first reflector (6) are arranged on a straight line (g)

such that the straight line (g) and a vertical (V) form an angle (φ) in the range of 30° to 70°.

2. The headlight according to claim 1, wherein the free-form parts of the second reflector (8) have faceting (18).

3. The headlight according to claim 1, wherein the reflector surface (7) of the first reflector (6) is ellipsoidally shaped, and the reflector surface (9) of the second reflector (8) is paraboloidally shaped.

4. The headlight according to claim 1, wherein the first focal point and the second focal point of the first reflector (6) are arranged on a straight line (g) that is inclined in relation to the vertical (V).

5. The headlight according to claim 1, wherein the second focal point of the first reflector (6) is arranged below the first focal point of the first reflector (6) and is arranged offset therefrom in the main radiation direction (H).

6. The headlight according to claim 1, wherein the straight line (g) and the vertical (V) form an angle (φ) in the range of 30° to 70°.

7. The headlight according to claim 1, wherein at least one of the second reflector (8) is curved in the main radiation direction (H) in such a way that a front edge (20) of the second reflector (8) is arranged to the rear of a front edge (21) of the first reflector (6) in the main radiation direction (H), or the rear edge (25) of the second reflector (8) is arranged in front of the rear edge (24) of the first reflector (6) in the main radiation direction (H).

8. The headlight according to claim 1, wherein a number of reflector modules (4) are arranged in pairs one above the other, the reflector modules (4) each having the same design.

9. The headlight according to claim 1, wherein a plurality of reflector modules (4) are integrally interconnected.

10. The headlight according to claim 1, wherein at least one reflector module (4) is a single metal-coated injection-molded part.

11. The headlight according to claim 1, wherein the reflector arrangement (1) is enclosed in a housing (3) that has cooling ribs on the outside.

12. The headlight according to claim 1, wherein the first reflector (6) is designed in such a way that the light (11) reflected on the first reflector (6) exits the first reflector (6) towards a lateral edge plane (13) extending perpendicular to the main axis (A) of the light source (2).

13. The headlight according to claim 1, wherein the second reflector (8) is arranged at a distance (a) from the first reflector (6).

14. A headlight for vehicles, comprising:

a light source (2), and a reflector arrangement (1) containing at least one reflector module (4):

the at least one reflector module (4) comprising:

a first reflector (6), which has a reflector surface (7) having a first focal point ($f_1$) and a second focal point ($f_2$), the light source (2) being arranged at the first focal point ($f_1$), and a second reflector (8), which has a reflector surface (9) having a focal point ($f_3$) that coincides with the second focal point ($f_2$) of the first reflector (6):

wherein the first reflector (6) is arranged in front of the light source (2) in the main radiation direction (H), the reflector surface (7) of the first reflector (6) being curved, with a first opening portion (22) arranged counter to the main radiation direction (H) and with a second opening portion (23) arranged in a manner offset by 90° in relation to the first opening portion (22) and facing towards the second reflector (8), wherein the reflector surface (9) of the second reflector (8) has free-form parts (18) such that light (11) striking the reflector surface (9) of the second reflector (8) is reflected in such a way that a light distribution (16) having a predetermined light/dark boundary (17) is produced, wherein the first focal point and the second focal point of the first reflector (6) are arranged on a straight line (g) such that the straight line (g) and a vertical (V) form an angle (φ) in the range of 30° to 70°, wherein the light source (2) is arranged in such a way that a main axis (A) of the light source (2) is directed in the main radiation direction (H) of the headlight, and in that a rear edge (24) of the first reflector (6) and a rear edge (25) of the second reflector (8) extend in a vertical plane ($V_{H1}$, $V_{H2}$) that is arranged in front of the first focal point ($f_1$) of the first reflector (6) in the main radiation direction (H).

15. A headlight for vehicles, comprising:

a light source (2), and a reflector arrangement (1) containing at least one reflector module (4):

the at least one reflector module (4) comprising:

a first reflector (6), which has a reflector surface (7) having a first focal point ($f_1$) and a second focal point ($f_2$), the light source (2) being arranged at the first focal point ($f_1$), and a second reflector (8), which has a reflector surface (9) having a focal point ($f_3$) that coincides with the second focal point ($f_2$) of the first reflector (6):

wherein the first reflector (6) is arranged in front of the light source (2) in the main radiation direction (H), the reflector surface (7) of the first reflector (6) being curved, with a first opening portion (22) arranged counter to the main radiation direction (H) and with a second opening portion (23) arranged in a manner offset by 90° in relation to the first opening portion (22) and facing towards the second reflector (8), wherein the reflector surface (9) of the second reflector (8) has free-form parts (18) such that light (11) striking the reflector surface (9) of the second reflector (8) is reflected in such a way that a light distribution (16) having a predetermined light/dark boundary (17) is produced, wherein the first focal point and the second focal point of the first reflector (6) are arranged on a straight line (g) such that the straight line (g) and a vertical (V) form an angle (φ) in the range of 30° to 70°, wherein the light source (2) is arranged in such a way that a main axis (A) of the light source (2) is directed in the main radiation direction (H) of the headlight, and in that a rear edge (24) of the first reflector (6) and a rear edge (25) of the second reflector (8) extend in a vertical plane ($V_{H1}$, $V_{H2}$) that is arranged in front of the first focal point ($f_1$) of the first reflector (6) in the main radiation direction (H), and wherein the first reflector (6) and the second reflector (8) are arranged spaced apart from a supporting element (10) that supports the light source (2).

* * * * *